United States Patent [19]

Werych

[11] 4,278,877

[45] Jul. 14, 1981

[54] ELECTRICAL HEATING UNIT WITH FLATTENED EMBEDDED HEATING COIL

[75] Inventor: Ewald R. Werych, Elm Grove, Wis.

[73] Assignee: General Signal Corporation, Stamford, Conn.

[21] Appl. No.: 62,987

[22] Filed: Aug. 2, 1979

Related U.S. Application Data

[63] Continuation of Ser. No. 862,907, Dec. 21, 1977, abandoned.

[51] Int. Cl.[3] ..... H05B 3/44; H05B 3/50

[52] U.S. Cl. ..... 219/544; 174/153 R; 219/459; 219/462; 219/464; 219/535; 219/541; 219/553; 338/255; 338/275; 338/276; 338/269; 338/282

[58] Field of Search ..... 219/345, 354, 390, 432, 219/433, 436, 443, 459, 462, 464, 467, 521, 530, 535, 540, 541, 544, 548, 553; 13/22; 174/98, 153 R; 29/611; 252/312, 313; 338/226, 235, 254, 255, 275, 276, 282, 302, 303, 306, 301, 296, 297; 339/218 R

[56] References Cited

U.S. PATENT DOCUMENTS

| | | | |
|---|---|---|---|
| 1,403,330 | 1/1922 | Lightfoot | 338/282 X |
| 1,636,372 | 7/1927 | Kohn | 338/275 X |
| 1,831,889 | 11/1931 | Skutta | 219/462 X |
| 2,064,971 | 12/1936 | Edison, Jr. | 338/255 X |
| 2,817,068 | 12/1957 | Schwing | 338/296 X |
| 3,248,679 | 4/1966 | Ganci | 338/264 |
| 3,500,444 | 3/1970 | Hesse et al. | 219/544 |
| 3,627,989 | 12/1971 | Heidler et al. | 219/553 |
| 3,646,321 | 2/1972 | Siegle | 219/464 |
| 3,870,861 | 3/1975 | Werych | 219/459 |
| 3,997,761 | 12/1976 | Gebien | 219/463 |

*Primary Examiner*—Volodymyr Y. Mayewsky
*Attorney, Agent, or Firm*—Parmelee, Johnson, Bollinger & Bramblett

[57] ABSTRACT

Resistance heating coils, flattened longitudinally along two sides to have generally oval cross-sections, are embedded in situ in a lightweight ceramic fiber insulating body adjacent to and extending along beneath the surface of the insulating body. Electrical terminal elements extend from the heating coils through the insulating body, and axial movement of the leads is prevented by anchoring members welded thereto. In one embodiment, the coils are embedded in an insulating body having a thickness no greater than about twice the depth of the heating coils. The resulting compact heating unit is sufficiently thin to be mounted as a retrofit item on the interior walls of an existing furnace.

5 Claims, 5 Drawing Figures

ELECTRICAL HEATING UNIT WITH FLATTENED EMBEDDED HEATING COIL

This is a continuation of application Ser. No. 862,907 filed Dec. 21, 1977 now abandoned.

BACKGROUND OF THE INVENTION

This invention relates to electric heating units and more particularly to such units in which coiled resistance heating elements are embedded in insulating bodies.

In U.S. Pat. No. 3,500,444 to W. K. Hesse, et al., a lightweight ceramic fiber insulation is disclosed. Due to energy saving advantages, such ceramic fiber insulation is often used in place of more dense fire brick for furnace linings. Most of these applications are for oil or gas fired furnaces; however, there is increasing interest in using electric heating elements in which heating coils are embedded in situ in ceramic fiber insulating bodies as taught in the Hesse et al. patent. In that patent, a portion of the heating coil is exposed above the surface of the insulating body in order to permit effective transmission and direction of heat.

The requirement that a portion of the coil be exposed beyond the surface of the insulating body leads to great manufacturing difficulties. As taught in Hesse et al. patent, the insulating body is formed by a vacuum activated filtering process in which the coil is positioned against a screen and liquid from a molding slurry is drawn from the slurry past the heating coil through the screen. Ceramic fiber from the slurry is retained by the screen and accumulates around the coil. It is difficult to arrange for each individual convolution of the coil to be partially exposed from the insulating panel.

An object of this invention is to provide a highly efficient heating unit having a heating coil embedded in an insulating body, yet which is not subject to the difficulties of manufacture resulting from exposing each convolution of the coil beyond the surface of the insulating body.

It is among the advantages of this invention that a flattened heating coil may be embedded in the insulating body and be maintained at a substantially lower temperature for a given oven temperature than would otherwise be possible for a totally embedded round coil.

SUMMARY

According to the invention in one of its aspects, an electrical heating unit comprises a resistance heating coil embedded in an insulating body adjacent to and extending along beneath the surface of the insulating body, the coil being flattened longitudinally such that each turn of the coil has a substantially linear segment lying generally in the plane of the surface of the insulating body.

According to other aspects of the invention, the coil is also flattened longitudinally in a plane set in from the surface of the insulating body and the coil is embedded in situ in a ceramic fiber.

In accordance with the invention in another of its aspects, an electrical heating unit is made by winding a circular heating coil, flattening the heating coil, placing the heating coil on the bottom surface of a mold, introducing a slurry including a suspension of ceramic fiber into the mold, and drawing the liquid from the slurry to deposit a body of ceramic fibers in the mold and thereby embed the heating coil within the body.

According to yet other aspects of the invention, the method of making the electrical heating unit includes the step of flattening the convolutions of the coil while they are closely spaced in side-by-side relationship and then stretching the heating coil after it is flattened.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being place upon illustrating the principles of the invention.

DESCRIPTION OF PREFERRED EMBODIMENTS

Figure 1:
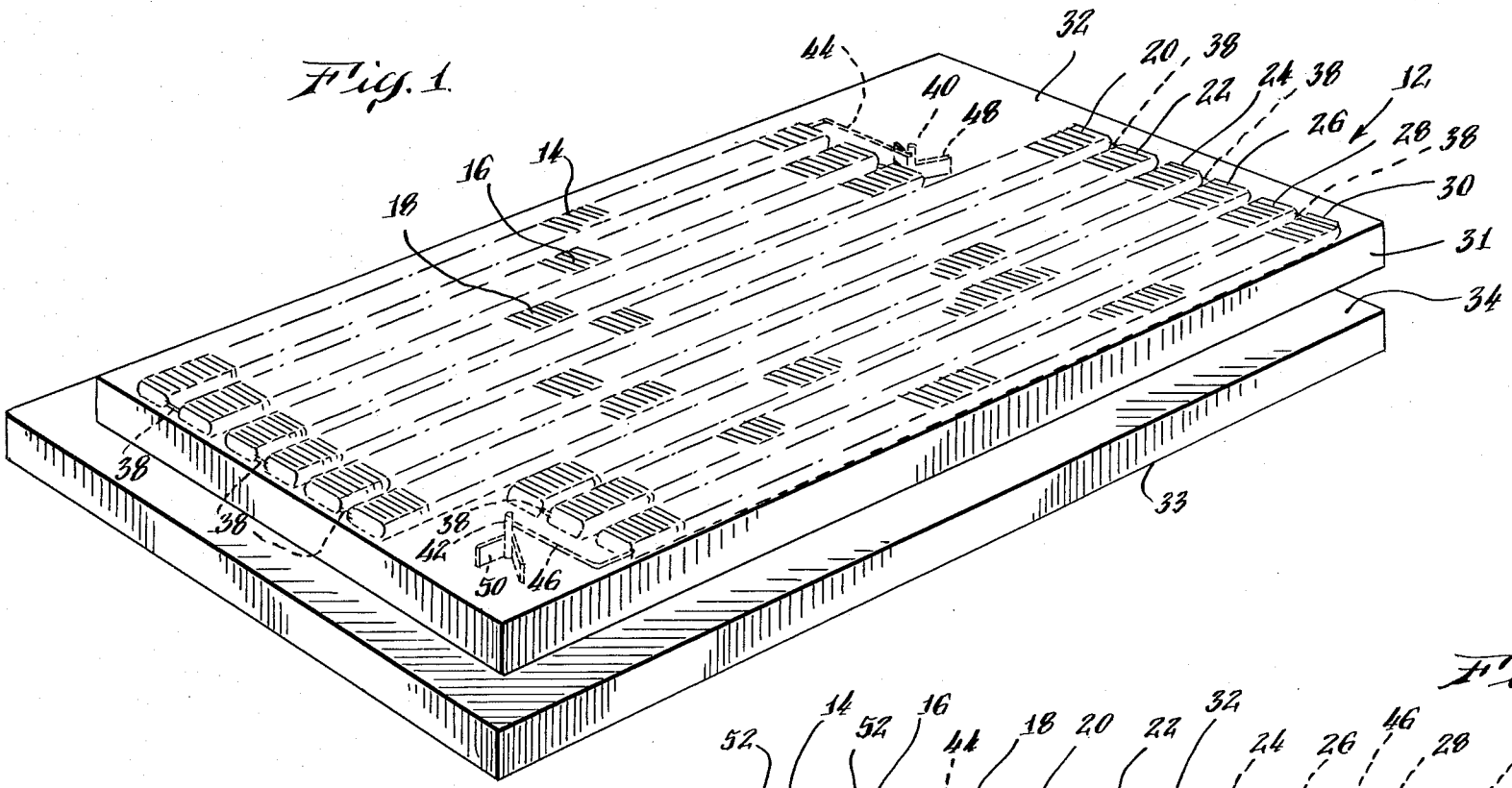
FIG. 1 is a perspective view of an electrical heating panel unit having flattened coils embedded in a ceramic fiber insulating body in accordance with the invention.

An electric heating unit 12 embodying the present invention is shown in FIG. 1. The unit includes a number of flattened oval electric heating coils 14, 16, 18, 20, 22, 24, 26, 28 and 30 embedded in a ceramic fiber insulating body 31. The heating coils are positioned adjacent to the surface 32 of the insulating body and that surface will be referred to as the hot face of the heating unit. The opposite surface 33 of the heating unit shown in FIG. 2 will be referred as the cold face, although the temperature at that face is somewhat above ambient during operation of the heating unit. The insulating body is preferably of the ceramic fiber type disclosed in U.S. Pat. No. 3,500,444 and may be molded to have a step 34 along three sides thereof and an overhang 36 along one side. The step and overhang are provided for convenient interfitting of a number of panel units in a furnace.

The electric heating coils are electrically connected in series by connecting wires 38. These connecting wires are welded to respective coil pairs prior to deposition of the insulating material forming the insulating body 31. Alternatively, the several coils may be formed from a single wire strand to avoid the need for intercoil welding. The nine heating coils in series are electrically connected across a low voltage, high current source by means of terminal pins 40 and 42 which extend through the insulating body 31 and protrude from the cold face 33. These terminal pins are electrically connected to respective coils 14 and 30 by lead wires 44 and 46. Each lead wire extends through a hole drilled transversely through the respective terminal pin and is welded thereto.

Anchoring ribbons 48 and 50 are also welded to the terminal pins. Each of these ribbons is preferably about 0.060 inches thick, 1 inch wide, and 2 inches long and is positioned within the insulating body with the ribbon faces perpendicular to the hot face 32 of the insulating body. Each ribbon is bent about a line perpendicular to the hot face to form an angle of about 90 degrees to increase the anchoring effect of the ribbons. With the anchoring ribbons, the terminal pins are less likely to be pushed through the lightweight insulating material if subjected to a sudden, accidental axial impact from the cold face side of the unit.

Figure 2:
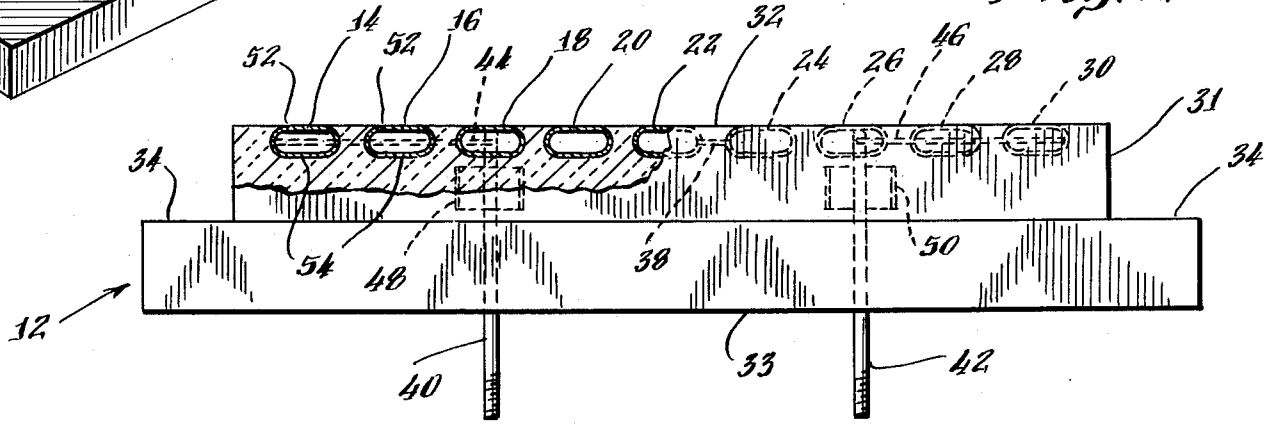
FIG. 2 is a front edge view of the electrical heating unit of FIG. 1 with a portion thereof broken away to show the generally oval shape of the flattened heating coils.
Figure 4:
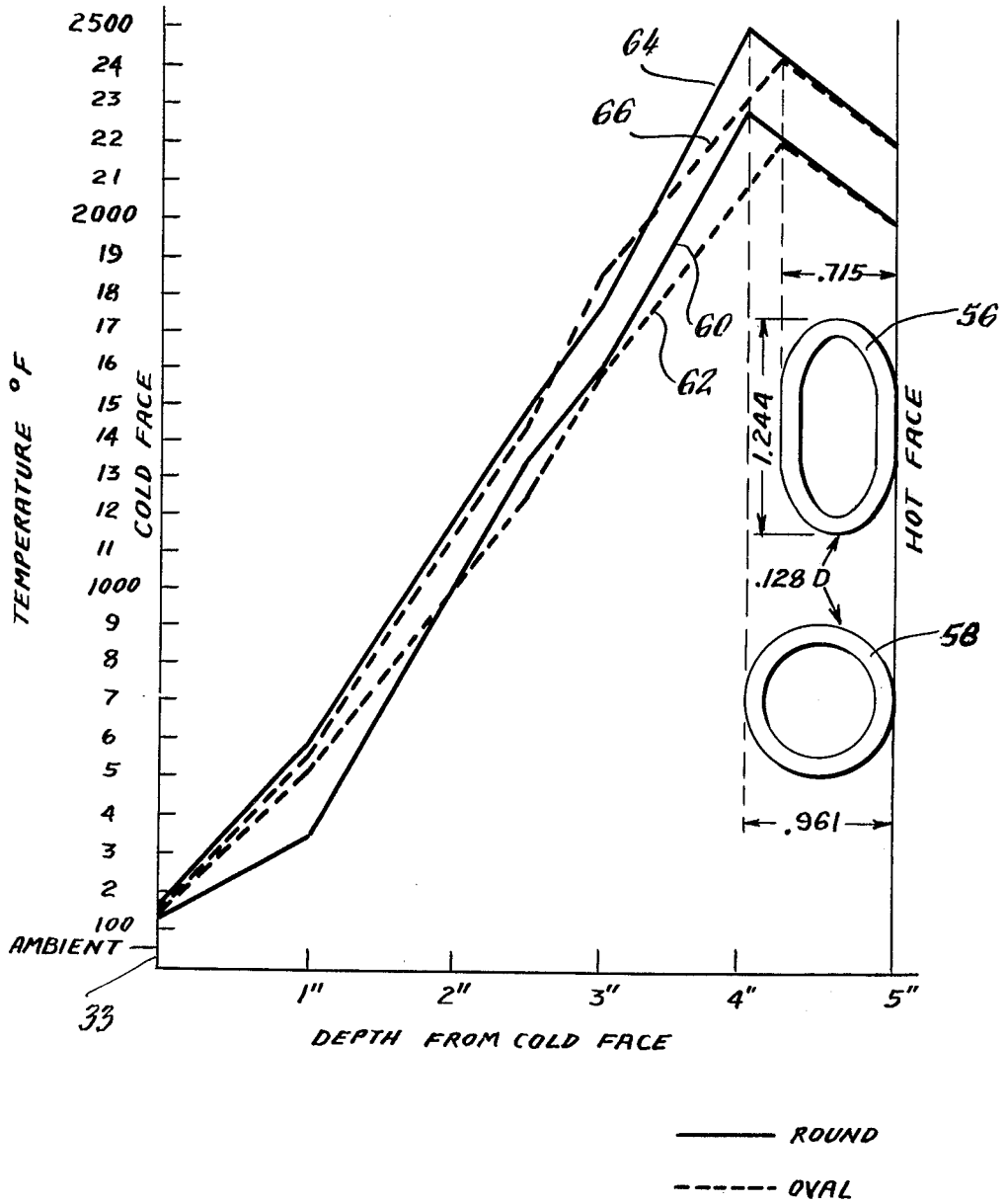
FIG. 4 is a graph demonstrating the results of tests run to compare the internal temperatures of two insulating bodies respectively having flattened and round coils embedded therein.

Each coil is flattened longitudinally such that, as best shown in FIG. 2, each turn of each coil has a substantially linear segment 52 lying generally in the plane of the surface of the insulating body. Thus, a substantial portion of each turn is at the hot face surface of the insulation body contiguous with the heated atmosphere while all coils are fully embedded in the insulating material. Each coil is also flattened longitudinally in a plane set in from the surface of the insulating body in order that each turn of each coil has a second substantially linear segment 54 lying generally in a plane parallel to the surface of the insulating body. With this flattening of the coils in the second plane, the interior segments of the embedded coil are positioned closer to the hot face 32 and further from the cold face 33 (as seen in FIG. 4) than would be the case with a nonflattened round coil. Thus, the advantageous effects of the two flattened segments of each turn are: (1) a reduced average distance of each turn from the hot face, (2) an increased average distance from the cold face, thereby reducing the insulation between the heat source and heated environment and increasing the insulation between the heat source and ambient environment, and (3) a greatly increased projected area of the flattened coil which is facing (and directed) through the insulation medium toward the interior of the furnace to be heated.

In a preferred example of this embodiment, each of the nine coil strips was formed of 14.44 feet of eight gage Kanthal A-1 wire, having a diameter of 0.128 of an inch. The wire was wound in closely spaced turns around a mandrel of 0.75 inch diameter circular cross section. The thus wound coil was then removed from the mandrel and, while the turns were still closely spaced in side-by-side relationship, the turns were flattened to a generally oval configuration as seen in FIG. 4 having a major outer diameter of 1.244 inches and a minor outer diameter of 0.715 inches as shown in this end view 56 of a flattened ovalized coil. Six of the flattened coils were then stretched to 28 inches and three of the coils were stretched to 33 inches. The coils were welded to the connecting wires and terminal pins and were placed on the bottom surface of a mold in the final arrangement shown in FIGS. 1 through 3 with the terminal pins 40 and 42 extending upwardly from the bottom surface of the mold. A slurry including a suspension of ceramic fiber was then introduced into the mold and the liquid was vacuum drawn from the slurry to deposit a body of ceramic fibers embedding the heating coils therein. It is noted that the major axis of the flattened ovalized coil is parallel with the hot face of the insulation panel. Consequently, the projected area of the resistance heating wire facing through the surrounding insulation medium directly toward the interior of the furnace is much greater than is the projected area of a round coil. In effect this projected area of the flattened coil 56 as seen in FIG. 4 is at a ratio of 1.244 to 0.961 as compared to the round coil 60. This ratio represents an increase of about 30 percent in the area of the heater wire facing through the insulation medium toward the furnace chamber.

From the method of manufacturing the electric heating unit, the significance of the anchor ribbon structure can be understood. Because the ceramic fibers settle down toward the bottom of the mold as the liquid is drawn through the mold bottom, to totally embed any anchoring means in the insulating unit, those anchoring means should advantageously be relatively thin in any horizontal plane. In this preferred embodiment the anchoring ribbons are only 0.06 inches thick. Although the ribbon is thin, it resists axial movement of the terminal pin because it is 2 inches long and bent at about 90 degrees; thus, the axial forces are resisted as the bent anchoring ribbon is pressed against a planar internal surface of the insulating body 31. The 1 inch width of the ribbon gives structural stability to the anchor itself.

The resistance heating unit described above was tested with respect to a panel containing a round coil. The round comparison coil was wound from identical eight gage Kanthal A-1, 0.128 diameter wire; however, this coil was not flattened and had an outer diameter of 0.961 inches. The flattened and round coils were each totally embedded in separate five inch thick panels of lightweight ceramic fiber insulating material. The thus formed heating units were operated in two test runs in separate ovens to provide hot face temperatures of 2,000 and 2,200 degrees Fahrenheit (°F.) in respective test runs. With the hot face temperatures set in each test run, the cold face temperature and internal temperatures at 1 inch, 2½ inches, and 3 inches from the cold face and at the back of the coil were measured for each test coil. For each hot face temperature of the test, it was determined that the back of the round coil was at a higher temperature than the back of the flattened coil. The results are shown graphically in FIG. 4.

The test results for the 2,000° hot face temperature test run are illustrated by lines 60 and 62 in FIG. 4. Line 60 shows the internal temperatures within the insulation panel for the round coil heating unit at the selected points and line 62 shows the internal temperatures for the flat coil heating unit. In that test, the temperature at the back of the round coil 58 was 2,295° F., but the temperature at the back of the flattened coil 56 was only 2,214° F., a difference of 81° F. Thus, for the given hot face temperature of 2,000° F., the temperature to which the flat coil was heated was substantially less than that to which the round coil was heated. Similarly, for the 2,200° F. hot face temperature, illustrated by lines 64 and 66 for the round and flat coils, respectively, the back surface of the round coil was 2,520° F., and the back surface of the flat coil was only 2,426° F., a difference of 94° F.

The increased temperature difference between the two coils with increased oven temperature suggests that the advantage of using a flat coil is particularly significant for high oven temperatures. Research has proven that operating temperatures in excess of 2,200° F. can be achieved using flattened, fully embedded heating elements while still providing normal life expectancy.

Figure 3:
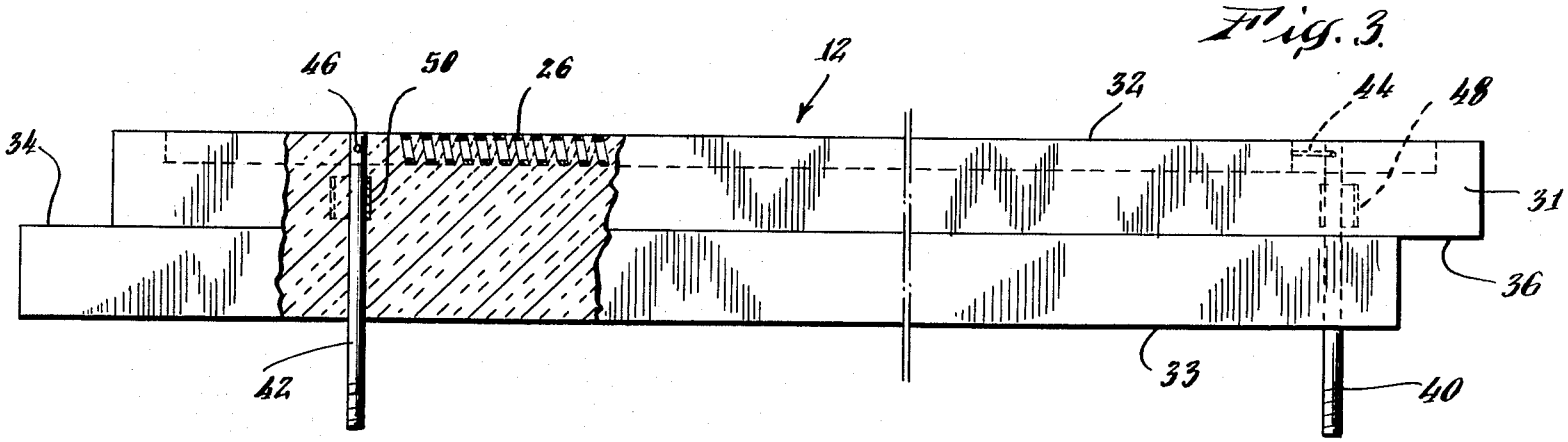
FIG. 3 is a side edge view of FIG. 1, partially broken away to show a flattened heating coil and terminal connection pin.

The 5 inch thick electric heating panel unit shown in FIGS. 1 through 3 is ideal for use as the internal lining of a new furnace. The unit provides both efficient electric heating and high heat insulation from the ambient. However, embodiments of this invention are not limited to heating units of the dimensions set forth above. Not only may the coil dimensions be varied, but also the depth of the insulating body is readily varied by changing the depth of the ceramic fiber slurry during the molding process. The dimensions of both the coils and the insulating body will be dictated by power requirements, operating temperatures, physical limits of furnace chambers and so on.

Figure 5:
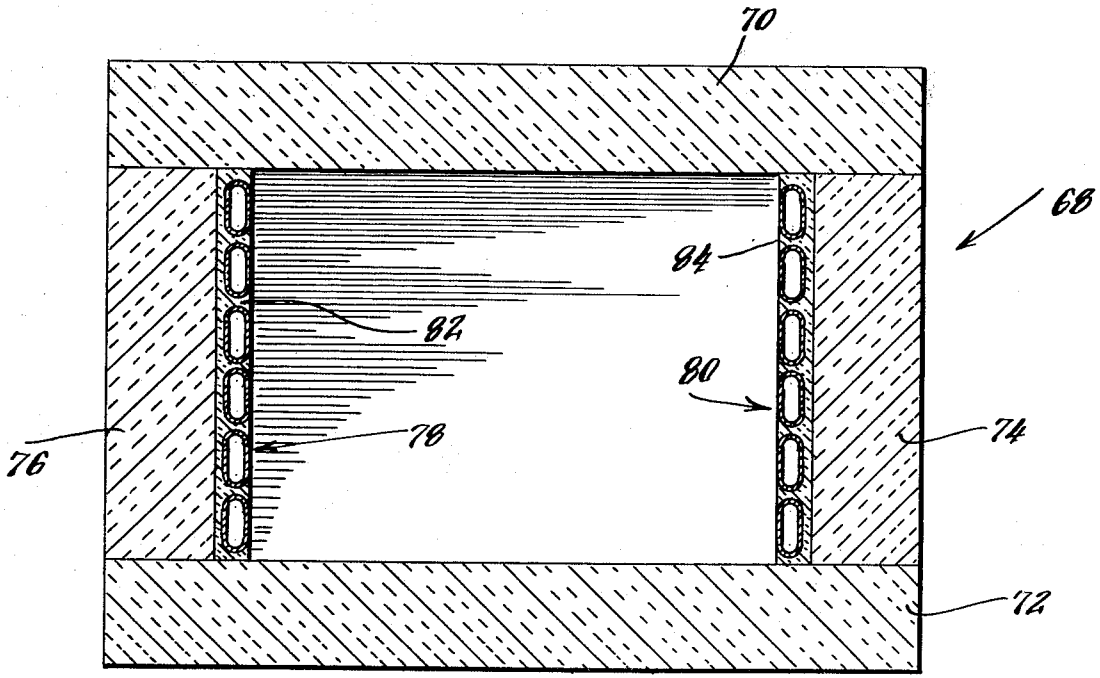
FIG. 5 is a sectional view of a furnace having electrical heating retrofit or replacement units embodying the invention mounted on the interior walls thereof.

By embedding the flattened coils described above in a thin insulating body, such as one having a thickness no greater than about twice the depth of the flattened resistance heating coil within the insulating body, a heating unit which is ideal for retrofit refurbishing of old furnaces or for converting old furnaces to electric heating is provided. As shown in FIG. 5, a furnace 68 includes an insulated top 70, insulated bottom 72, and insulated side walls 74 and 76. These walls may have electric heating elements embedded therein or the furnace may simply be an oil or gas fired furnace or the like. If the walls have electric heating elements embedded therein which have deteriorated with age, they are electrically disconnected and left in place. Replacement heating units 78 and 80 are then placed over the old heating elements and secured to the interior of the furnace walls. Because the furnace already has sufficient insulation the insulating bodies 82 and 84 of the respective heating units 78 and 80 are relatively thin so as not to reduce the furnace volume more than necessary.

As can readily be seen by comparing the depths of the flattened coil 56 and round coil 58 from the hot face 32 in FIG. 4, a flattened coil can be totally embedded in a much thinner insulating body than can the round coil. This favorable result is over and above the advantage of high heating efficiency with ease of manufacture.

While the invention has been particularly shown and described with reference to preferred embodiments thereof, it will be understood by those skilled in the art that various changes in form and details may be made therein without departing from the spirit and scope of the invention as defined by the appended claims.

I claim:

1. An electric heating unit comprising:

a form-retaining ceramic fiber insulating body having a heat-radiating surface;

an elongate resistance heating coil of wire having a plurality of turns at least substantially fully embedded in situ in the ceramic fiber material of said insulating body along said heat-radiating surface;

each turn of said coil being formed with a substantially linear first segment lying generally parallel to and closely adjacent said surface of said insulating body, in contact with said ceramic material at least substantially along the entire length of said first segment, and a second segment lying generally parallel to said surface wholly within said body at a predetermined distance from said first segment;

the portion of said heat-radiating surface immediately adjacent and extending alongside said first coil segment being substantially linear in a direction parallel to said first segment;

the lateral dimension of each turn of said coil in a direction parallel to said first segment being greater than said predetermined distance; and means extending from said insulating body making electrical connection to the ends of said heating coil.

2. The electric heating unit as claimed in claim 1, wherein said second segment of said coil is a substantially linear segment identical to said first segment.

3. An electric heating unit comprising:

a form-retaining insulating body comprised of a mass of insulating material and having a heat-radiating surface;

a resistance heating coil of wire having a plurality of consecutive turns at least substantially fully embedded in said material of said insulating body along said heat-radiating surface;

each of the turns of said coil being formed to provide a configuration wherein each turn includes (1) a substantially linear first segment lying generally in said heat-radiating surface of the insulating body, in contact with said insulating material at least substantially along the entire length of said first segment, and (2) a substantially linear second segment lying generally parallel to said first segment wholly within said body and in contact with said insulating material along the entire length of the segment;

the portion of said heat-radiating surface immediately adjacent and extending alongside said first coil segment being substantially linear in a direction parallel to said first coil segment;

the lateral dimension of each turn of said coil in a direction parallel to said first and second segments being greater than the distance said second segment is set in from said first segment; and means extending from said insulating body making electrical connection to the ends of said heating coil.

4. The electric heating unit as claimed in claim 3, wherein the thickness of said insulating body is no greater than about twice the depth of said resistance heating coil within said insulating body.

5. An electrical heating unit comprising:

a form-retaining insulating body formed of a mass of insulating material and having a heat-radiating surface;

a resistance heating coil of wire comprising a plurality of consecutive ovalized turns all at least substantially fully embedded in said insulating body along said heat-radiating surface;

each turn of said coil having a major axis and a minor axis transverse to and smaller than said major axis, the major axis of each of said ovalized heating coil turns being generally parallel to the portion of said surface of said insulating body which is immediately adjacent such turn, and being within said body at a predetermined distance from said surface;

each turn of said coil having an outer segment which is generally parallel to said portion of said surface and lying generally in said surface so that said outer segment is at least partly surrounded by and in intimate contact with said insulating material along at least substantially the entire length of said outer segment;

each turn of said coil having a second segment directly opposite the first segment of that turn and set in from said body surface at a depth corresponding to said minor axis and in intimate contact with said insulating material; and means extending from said insulating body making electrical connections to the ends of said heating coil.

* * * * *